US005794411A

United States Patent [19]

Combs et al.

[11] Patent Number: 5,794,411

[45] Date of Patent: Aug. 18, 1998

[54] SINGLE STATION FOOD PRODUCT WRAPPING MACHINE

[75] Inventors: Timothy F. Combs, Lambertville; James O. Byrd, Monroe, both of Mich.

[73] Assignee: Research Products Manufacturing, Inc., Ida, Mich.

[21] Appl. No.: 687,121

[22] Filed: Jul. 24, 1996

[51] Int. Cl.[6] ..... B65B 11/00

[52] U.S. Cl. ..... 53/466; 53/460; 53/401; 53/223; 53/228

[58] Field of Search ..... 53/460, 461, 466, 53/401, 464, 122, 221, 222, 223, 209, 228

[56] References Cited

U.S. PATENT DOCUMENTS

| | | | |
|---|---|---|---|
| 1,064,964 | 6/1913 | Dooley | 53/222 |
| 1,129,975 | 3/1915 | Giroud | 53/222 |
| 1,458,977 | 6/1923 | Escobales | 53/464 |
| 1,858,189 | 5/1932 | Downing | 53/222 |
| 2,094,402 | 9/1937 | Grover | 53/222 |
| 2,100,739 | 11/1937 | Gilfillan | 53/222 |
| 3,266,214 | 8/1966 | Kramme | 53/122 |
| 3,452,515 | 7/1969 | Bongartz et al. . | |
| 3,583,603 | 6/1971 | Freckman et al. . | |
| 3,688,468 | 9/1972 | Erekson | 53/122 |
| 3,864,891 | 2/1975 | Piereder | 53/122 |
| 3,979,021 | 9/1976 | Reinecke . | |
| 4,505,311 | 3/1985 | Kramer et al. . | |
| 4,667,709 | 5/1987 | Fischer et al. . | |
| 4,750,531 | 6/1988 | Juenkersfeld et al. . | |
| 4,860,926 | 8/1989 | Juenkersfeld et al. . | |
| 4,964,545 | 10/1990 | Mooshammer . | |
| 5,159,959 | 11/1992 | Böhm . | |
| 5,379,574 | 1/1995 | Fischer et al. . | |

*Primary Examiner*—Daniel Moon
*Assistant Examiner*—John Paradiso
*Attorney, Agent, or Firm*—John R. Benefiel

[57] ABSTRACT

A food product wrapping machine includes a frame having through cavities each receiving a food product stick pushed into the cavity atop a wrapper sheet. An inwardly projecting blade at each end with a clearance space causes formation of a folded flap and a pair of wings on the wrapper as a stick enters a cavity end. Folding fingers at each end of the cavity engage the wrapper wings and fold them against the stick. Inward movement of a pair of folding blades creates additional top flaps on the sheet, which are then folded down by pivotal plates to complete the wrapping process.

10 Claims, 7 Drawing Sheets

SINGLE STATION FOOD PRODUCT WRAPPING MACHINE

BACKGROUND OF THE INVENTION

This invention concerns wrapping of pasty or moldable food products such as butter or margarine. Butter or margarine are commonly wrapped formed into quarter pound or one pound pieces in the form of elongated blocks referred to as sticks. The product sticks are then individually wrapped prior to being packaged in paper cartons.

The wrapping is done with suitable grease impervious printed sheets. This wrapping of the individual product sticks is done by automated machinery which also includes the molding or forming of the food product into the stick form in a subsequent multistage operation for wrapping the formed stick with the sheet of paper.

The wrapped stick is then conveyed to a packaging machine which may also be included in the same apparatus.

Heretofore the molding and wrapping operation have been conducted in a series of separate stations in the machine with transport of the product and sheet successively through a number of individual stations. Such transport is by a large carrier disc operated with a geneva wheel motion or with a linear conveyor. In each station, a portion of the steps required to complete the product wrapping operation is carried out.

Such an arrangement results in a quite complex apparatus which is costly to construct and also requires considerable maintenance in order to keep in proper working order due to the many working parts and the complex transport mechanisms required.

It is the object of the present invention to provide a greatly simplified food product wrapping machine in which the entire operation is carried out in a single station and which can be combined with a food product molding device so as to provide a low cost, low maintenance apparatus.

SUMMARY OF THE INVENTION

This object and others which will become apparent upon a reading of the following specification and claims are achieved by a single folding frame which may have a series of rectangular through cavities, one cavity for each stick to be wrapped within the folding frame. Each cavity has associated therewith a series of cam and pusher devices which act on a sheet of wrapping paper as the wrapping paper is pushed through the cavity with the food stick to be wrapped such as to execute successive folding operations which result in a fully wrapped stick which is pushed out of the cavity by the advance of the next wrapped stick.

The first camming device comprises a pair of flat rectangular blades projecting towards the cavity from each end with a clearance gap on either side of the flat blades between the sidewall of the top of the folding frame. As the sheet is pushed into the cavity, the central portion of either end of the sheet is bent upwardly towards the stick end and a pair of fold wings are simultaneously formed which pass through respective gaps allowing the food stick and sheet to advance into the cavity.

A pair of chisel pointed folding cams are located on either side of the cavity, the folding cams projecting horizontally and forwardly spaced apart. The respective fold wings successively encounter the spaced cam fingers which fold the wing folds in overlapping fashion against each end of the food stick as the food stick is advanced to the bottom of the folding frame cavity.

A pair of rectangular folding blades is then advanced through slots so as to enter the cavity at a level aligned with the top of the food stick engaging the folded sheets so as to again force the sheet central regions onto the top of the folding stick, each forming opposite top wing folds which project upwardly into the cavity against upwardly projecting flaps on either side of the sheet.

A pair of top flap folding plates are recessed into the sidewall of the cavity at a level even with the top of the food stick when the food stick has been fully advanced to the bottom of the cavity. Each of the folding plates are successively pivoted into the cavity folding each top flap atop the food stick.

The next successive food stick forces the completely folded food stick out of the cavity and onto a conveyor.

The folding frame may be combined with a stick forming apparatus comprised of stick forming frames which can be shuttled back and forth through a product dosing mold. Each frame section is aligned with a corresponding folding frame. The formed product sticks are pushed out of the forming frame and through the folding frames successively.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

According to the concept of the present invention, the food stick wrapping is carried out in a folding frame which is shown in FIGS. 1–7. The folding frame is depicted as a two cavity configuration.

Figure 8A:
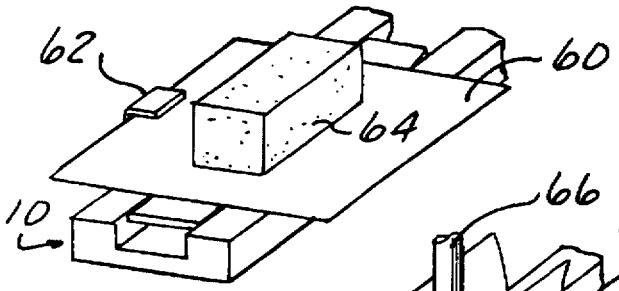
FIGS. 8A–8G are perspective illustrative views of the successive folding stages executed in the folding frame shown in FIGS. 1–7 together with a conveyor receiving the wrapped food product sticks for transport to the next operation.
Figure 8B:
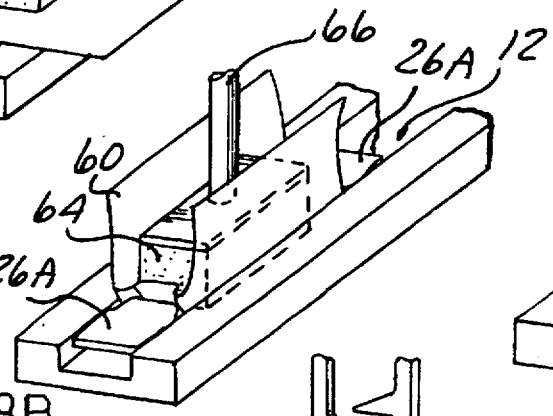
Figure 8C:
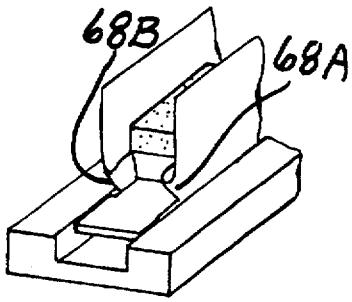
Figure 8D:
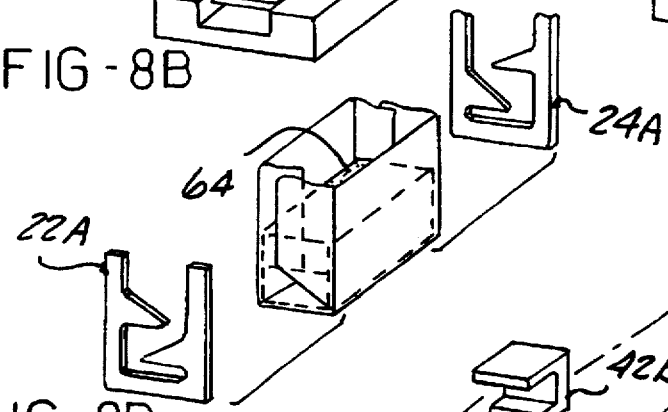
Figure 8E:
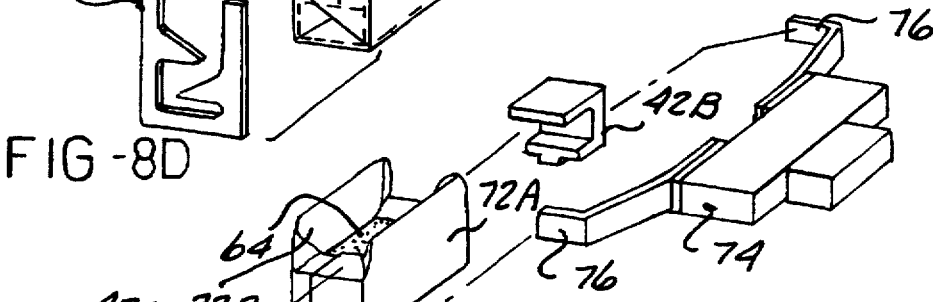
Figure 8F:
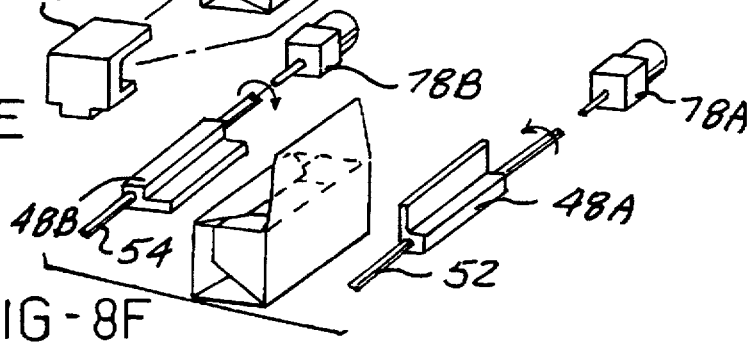
Figure 8G:
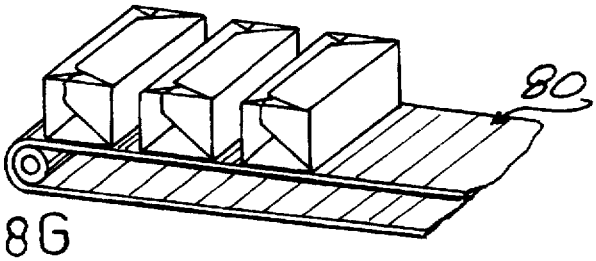
Figure 9:
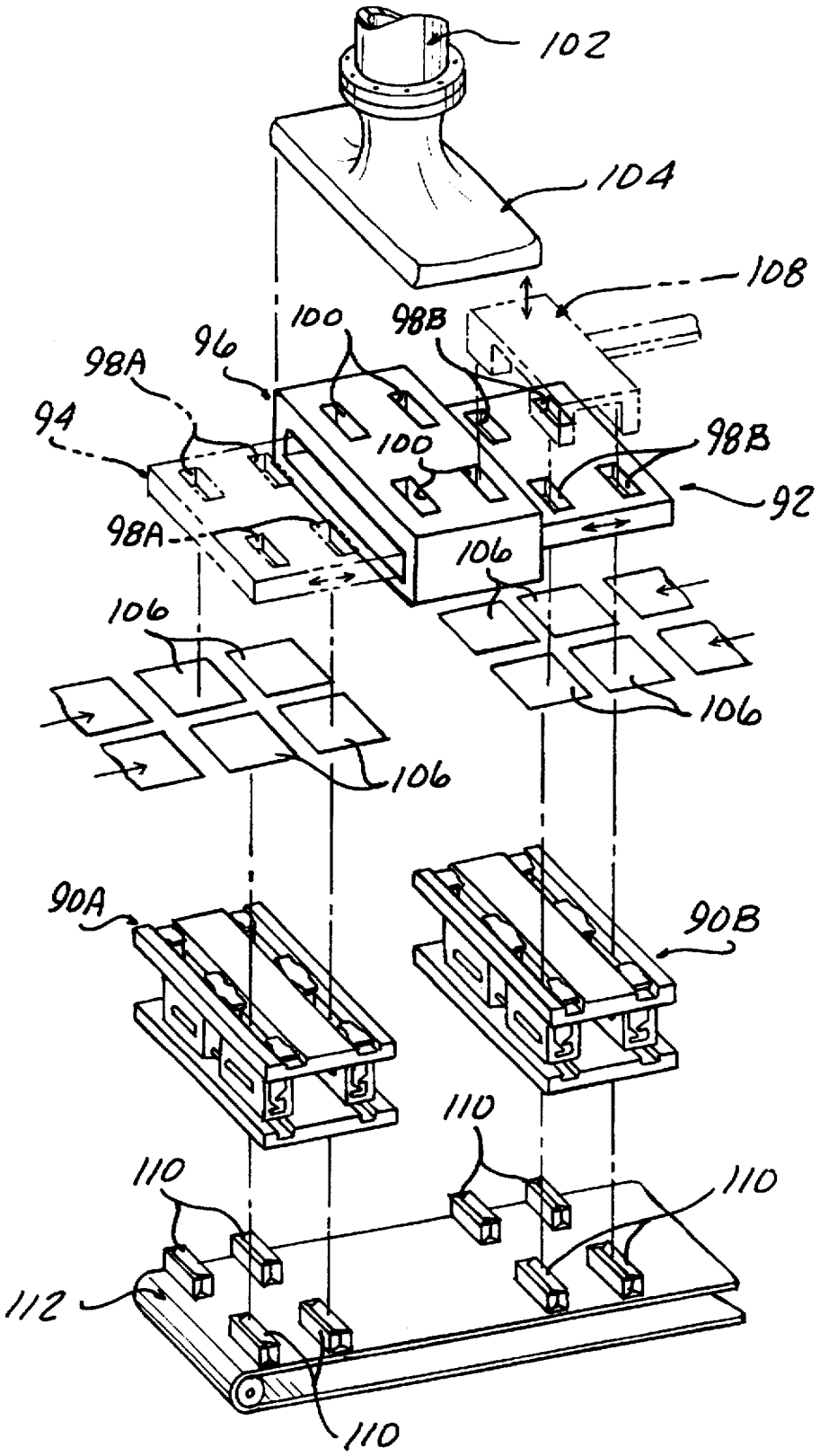
FIG. 9 is an exploded illustrative perspective view of a stick molding frame and nozzle, associated with a pair of four cavity folding frames and a transport conveyor.

For the sake of clarity, a four cavity configuration as depicted in FIGS. 8 and 9 may also advantageously be employed.

Referring to these Figures, the folding frame 10 provides a structure defining a pair of rectangular through cavities 12 extending through the folding frame. The rectangular cavity 12 is defined by an opening in top plate 14 and bottom plate 16 aligned with each other and spaced apart by sets of side plates 18A, 20A, 18B, 20B and sets of end plates 22A, 22B, 24A, 24B, respectively.

Figure 1:
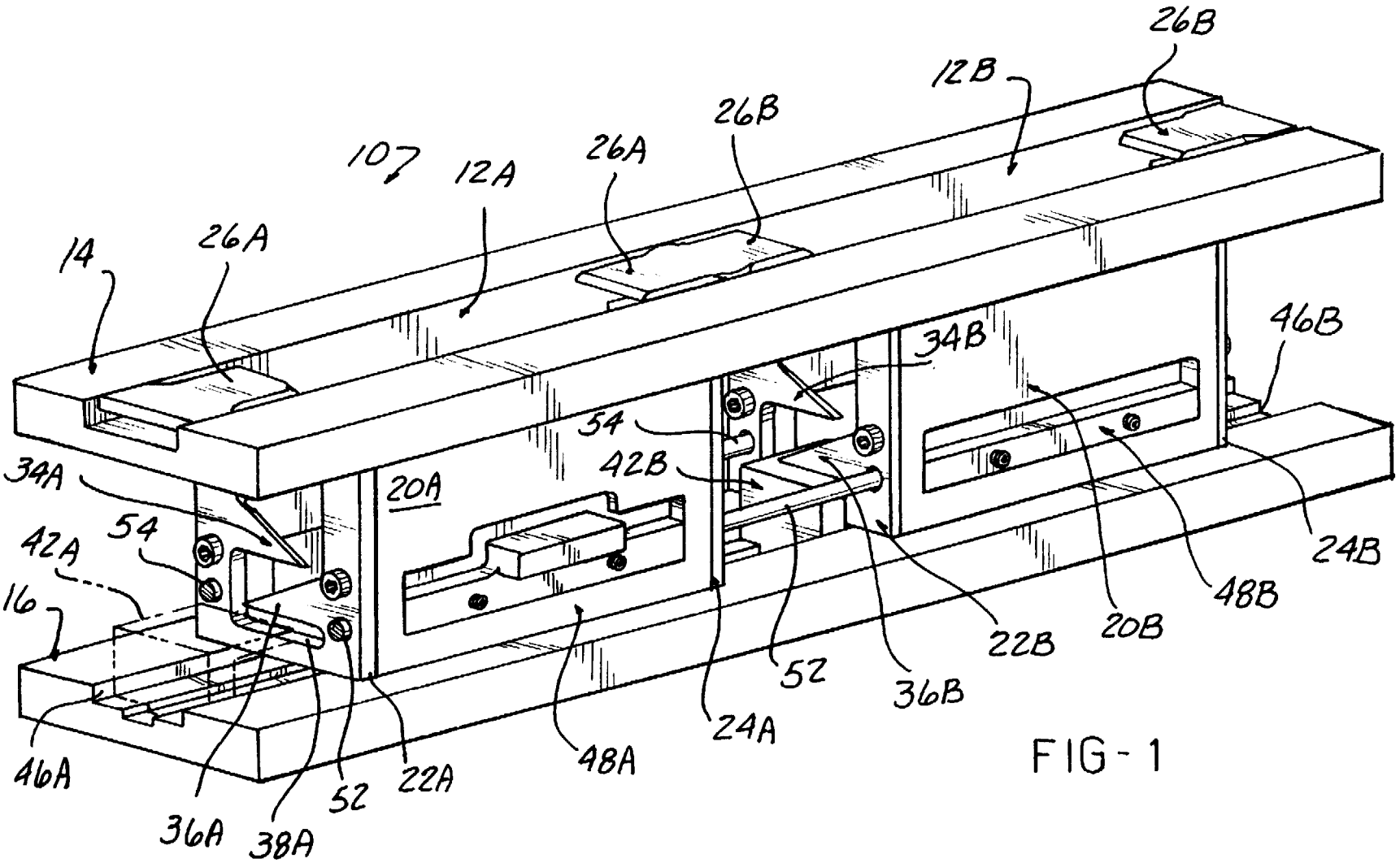
FIG. 1 is a perspective view of a dual cavity folding frame according to the present invention.
Figure 2:
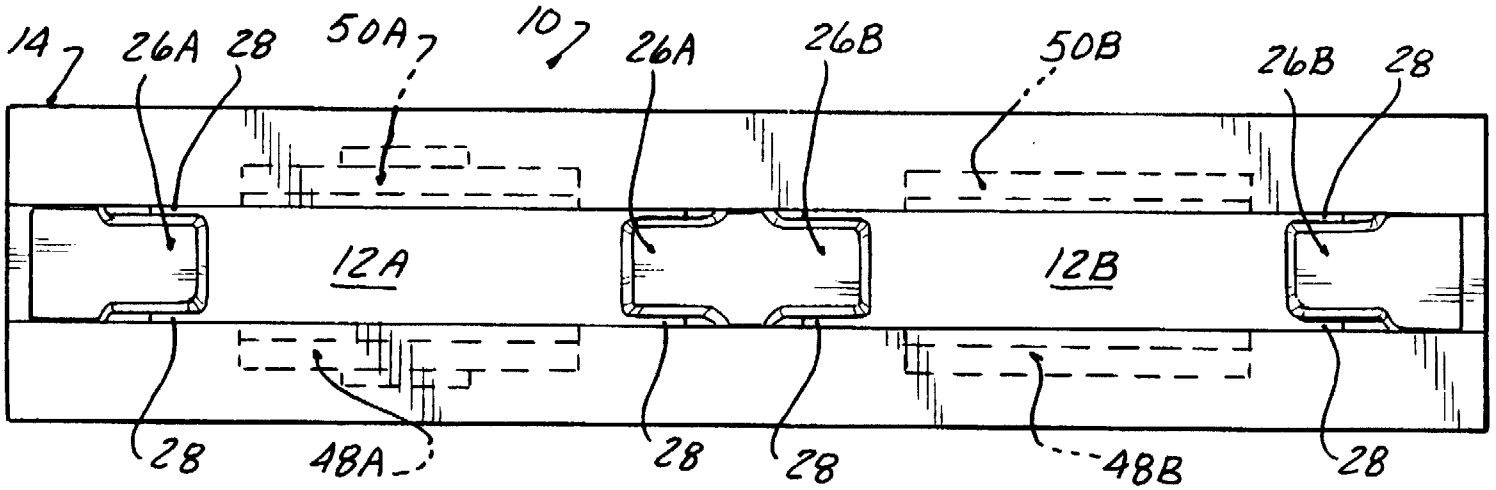
FIG. 2 is a plan view of the folding frame shown in FIG. 1.
Figure 3:
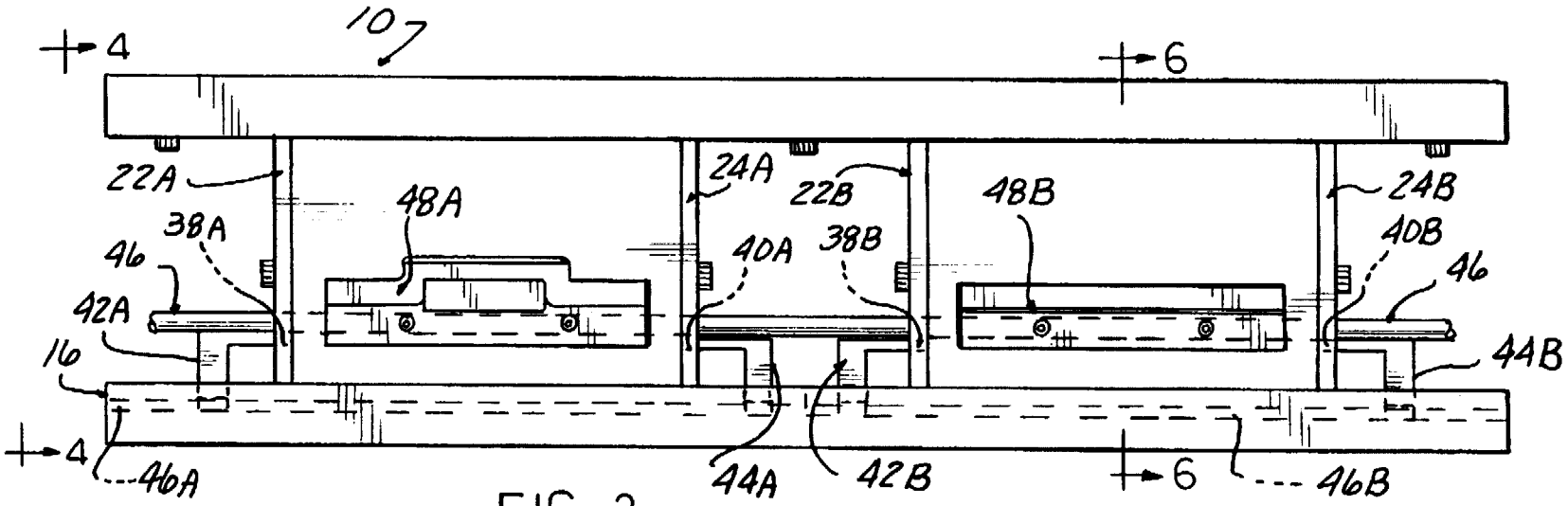
FIG. 3 is a side elevational view of the folding frame shown in FIGS. 1 and 2.
Figure 5:
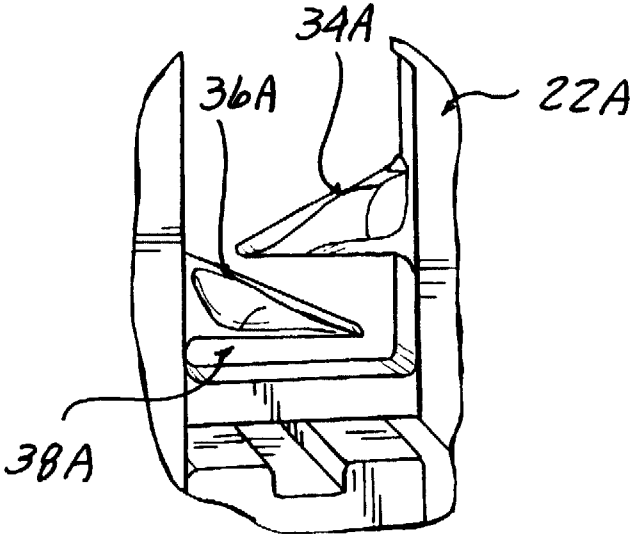
FIG. 5 is a fragmentary perspective end view of the cam fingers included at either end of the folding frame shown from the inside to reveal the contours thereof.
Figure 4:
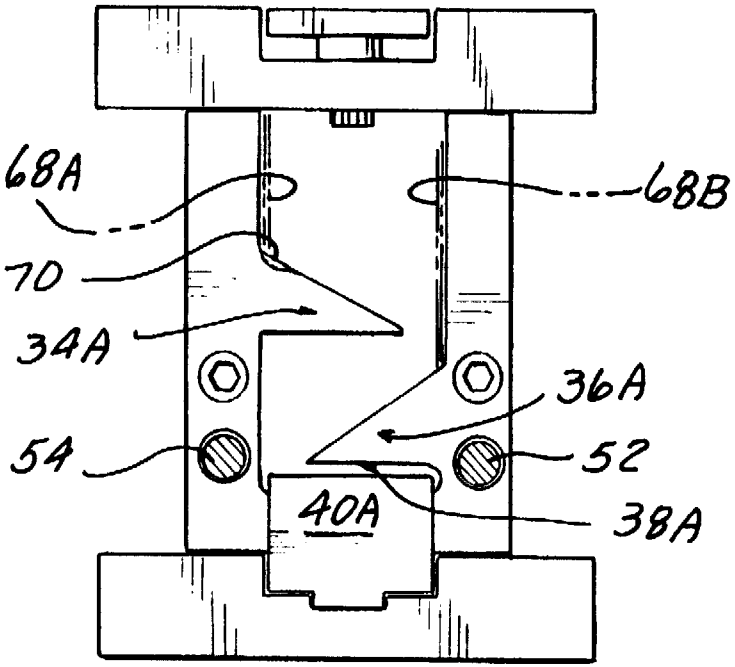
FIG. 4 is an end view taken in the direction of the lines 4—4 in FIG. 3.
Figure 7:
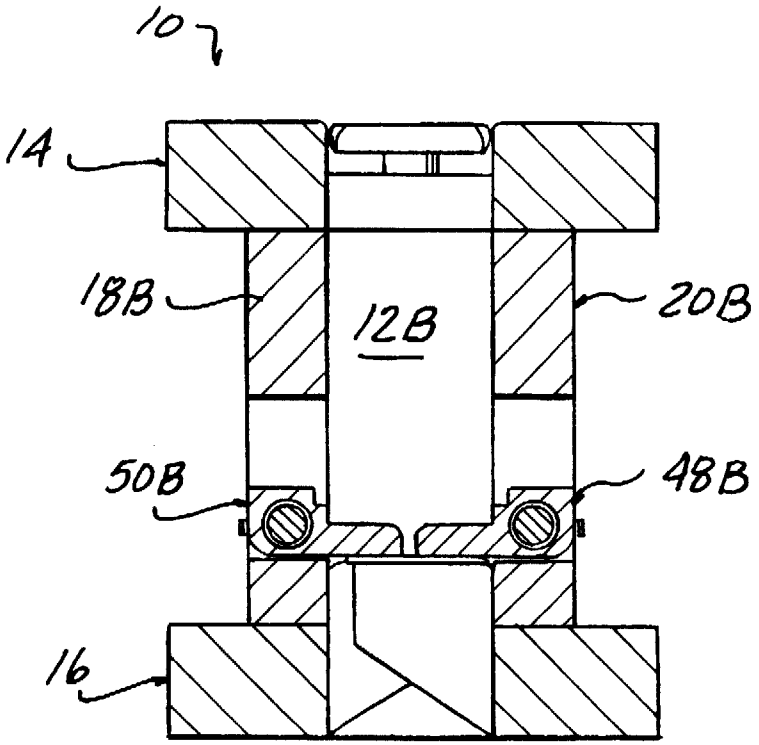
FIG. 7 is a transverse sectional view showing the folding plates in their fully advanced folded pivoted position.
Figure 6:
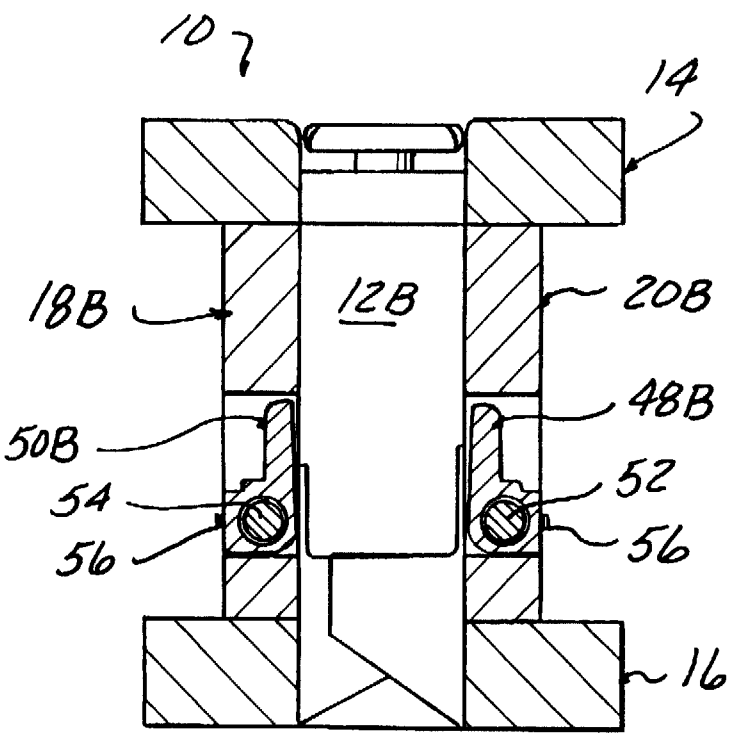
FIG. 6 is a transverse sectional view taken through the folding frame along the lines 6—6 in FIG. 3 with the top folding plate in the pivoted recessed position.

At the inner side of each cavity 12A, 12B is provided a fold forming flat blade 26A, 26B. The two adjacent blades 26A, 26B at the center can be made of a single piece as shown in FIG. 1.

Each of the blades 26A, 26B has a portion protruding into the respective cavities 12A, 12B to be overhung at the upper edge thereof.

A clearance slot 28 is provided alongside the three side edges of each of the blades 26A, 26B. The top surface of the blades is also provided with a chamfered surface 30 extending about the perimeter thereof.

The blades 26A, 26B are also recessed into the top of the upper plate 14 lying within a slot 32 extending across the top and entering into each of the cavities 12A, 12B so that the upper surface of the top plate 14 and the upper surface of the blades 26A, 26B are flush with each other.

Lying below the blades 26A, 26B are a pair of vertically spaced cam fingers 34A, 36A and 34B, 36B which extend toward each other but being vertically separated.

Below the cam fingers 34A, 34A, 34B, 36B are horizontal slots 38A, 40A, 38B, 40B in each end plate 22A, 22B, 24A, 24B adapted and sized to receive a flat inward projecting blade portion of pairs of slider shoes 42A, 42B, 44A, 44B which are slidably mounted in a guide track 46A, 46B formed in the upper surface of the bottom plate 16 aligned with the slots 38A, 40A, 38B, 40B. Recessed into the inner surface of each side plate 18A, 20A, 18B, 20B is a pivoted top flap folding plates 48A, 50A, 48B, 50B which are pivotally supported on elongated rods 52 and 54 with set screws 56 allowing transmission of rotation from actuators powering rotation of the rods 52 and 54.

FIG. 8 illustrates the function of each of the above-described elements.

During the first step, a rectangular flat sheet of paper 60 is positioned atop the folding frame 10 properly located as with the stop 62. The rectangular stick of food product 64 is pushed as out of a mold cavity onto the sheet material 60.

A plunger 66 advances the food product stick 64 into the cavity 12A of the fixture forcing the paper down into the cavity as well.

The projecting flat blades 26A prevent the center end sections of the sheet 60 from advancing into the cavity 12A, thus constraining an upward folding of the sheet material towards the respective end face of the food stick 64.

As the action proceeds, the excess sheet material is directed into the slots 28 to form the wing folds which project away from the end face of the food product stick 64, as indicated to the right side in FIG. 8.

Continued advance of the food product stick 64 into the cavity 12A results in engagement of the wing fold 68 with each respective cam finger 34A and 36A. The bottom edge of the wing folds engage the surface of each folding finger 34A and 36A.

The upper folding finger 34A and lower folding finger 36A are each provided with rounded contours facing toward the inside of the cavity 12A and which lessens toward the outboard end of the respective cam finger such as to create a surface shape tending to cam the wing fold 38A, 38B toward each other so as to initiate the folding action rather than a tearing or shearing of the paper flap.

The surface contour of the upper shoe 34A is extended so as to create a slight pocket 70 which insures that tearing of the paper does not occur, reliably creating a corner as the wing fold 68A is cammed toward the end face of the product stick 64.

The vertical spacing of the fingers 34A and 36A create a successive sequential folding action with the flaps 68A folded over and thence the wing fold 68B resulting in the intermediate folding stage shown in FIG. 8D.

As shown in FIG. 8E, shoes 42A and 42B have their upper blade portion aligned with the top of the food product stick 64 such that when advanced through the respective slots in the end plates, the center portion of the upwardly projecting sheet material is folded downwardly against the top of the food product stick with a pair of wing folds formed at each corner in similar fashion to the initial wing fold formation shown in FIGS. 8B and 8C creating a pair of top flaps 72 extending longitudinally along the food product stick 64.

The advance of the shoes 42A and 42B towards each other to cause the upper blade portions to pass over the top of the food product stick 64 can be carried out by any suitable actuator. A gripper actuator 74 is shown in FIG. 8E which has a pair of fingers 76 which straddle the two sliding shoes 42A and 42B which are hydraulically or pneumatically advanced towards each upon actuation and thence reversed to bring the shoes 42A and 42B back to their spread apart withdrawn position.

Finally, in FIG. 8G the top flaps 72A and 72B are successively folded downward atop the food stick by pivoting of the shafts 52 and 54 so as to cause the top folding plates 48A and 48B to be sequentially rotated out of the recess in the sidewall and fold the top flaps down with suitable rotary actuators 78 being used for this purpose.

The actuator shafts 52 and 54 extend between the top folding plate of each cell 12A and 12B of the folding frame 10.

It is noted that the paper is maintained in its folded position by contact with the food product in the case of butter or margarine. Each completely wrapped food product stick 64 is deposited on a conveyor 80 as shown in FIG. 8G as the next succeeding food product stick 64 is advanced into the cavity 12A and 12B to be pushed out of the cavity and onto the conveyor as indicated.

FIG. 9 shows the combination of a pair of four cavity folding frames 90A, 90B with a four cavity mold assembly 92 which includes a mold cavity shuttle 94 movable within a mold housing 96 to alternately position a respective grouping of four cavities 98A or 98B beneath ports 100, or a respective folding frame 90A or 90B.

The ports 100 are aligned with a product tube 102 and preformer 104 through which food product is forced to fill the set of cavities 98A or 98B.

When one of the cavity sets 98A or 98B is being filled, the other is aligned over the respective folding frame 90A, 90B.

A sheet feeder (not shown) positions paper sheets 106 over the cavities in each frame 90A, 90B. A pusher 108 has fingers which advance the formed product sticks out of the mold cavities 98A, 98B and into the folding frame cavity.

The wrapped sticks 110 are deposited on a conveyor 112.

It is noted that the folding frames can be oriented either vertically or horizontally to suit the particular orientation.

Suitable spring loaded shoes (not shown) can be used to hold the product sticks in their folding cavity until pushed out by the next succeeding wrapped stick, in a manner well known in the art.

Figure 10:
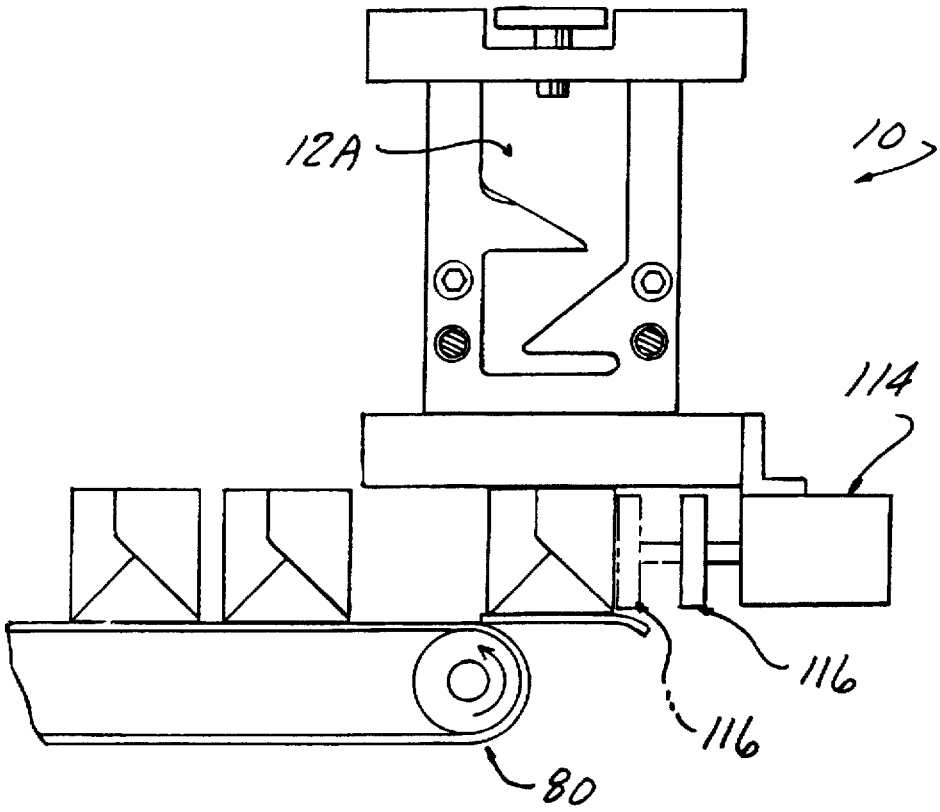
FIG. 10 is a diagrammatic end view of a folding frame equipped with an eject stop mechanism for insuring proper positioning of the product sticks in the folding frame.
Figure 11:
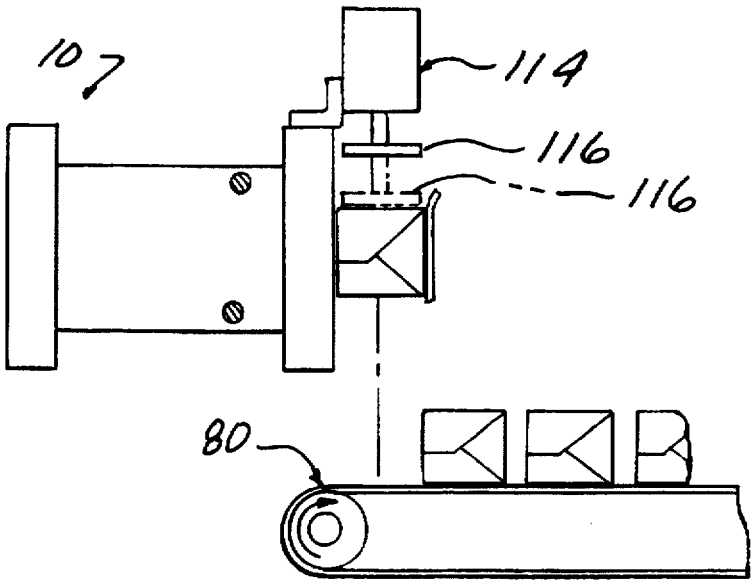
FIG. 11 is a diagrammatic end view of a horizontally oriented folding frame equipped with the eject stop mechanism of FIG. 10.

As an alternative, a positive stop can be employed as shown in FIG. 10. A power cylinder 114 has a plastic block 116 fixed to the end of the output rod 118. When the cylinder 114 is operated to extend the rod 118, the plastic block 116 is positioned below the cavity 12 of the folding frame 10 so as to hold the ejected wrapped product stick in position so as to prevent premature ejection of the next stick. The cylinder is operated to retract the block 116 and allow the stick to drop onto the conveyor 80, and then again extend the block 116 to avoid ejection of the next stick.

This arrangement can also be used with a horizontal orientation of the frame 10.

We claim:

1. A method of wrapping a product formed into a stick having a rectangular cross sectional shape and four parallel side surfaces and two end surfaces comprising the steps of positioning a rectangular sheet of wrapping sheet material of greater size than the shape of said stick against a face of a rectangular cavity formed in a folding frame and opening onto a face of said folding frame to define a rectangular opening matched to said product stick shape, but slightly oversized;

pushing said product stick with one side surface of said sheet into said opening to cause folding of all four sides of said sheet up against two respective side surfaces and two end surfaces of said product stick;

forming four wing folds at each end face of said one surface extending longitudinally away from said end surfaces while accommodating said wing folds in slots in said folding frame aligned with a respective one of said two sides;

further advancing said product stick into said cavity while engaging one wing fold at each end with a folding finger to fold each wing fold against a respective end face;

further advancing said product stick into said cavity while engaging the other wing fold at each end with a second folding finger to fold the other wing folds against the product stick end face;

pushing a blade into the cavity at each end against a part of a portion of said sheet material folded against said end face to fold said sheet parts against an upper side of said product stick while forming backwardly extending wing folds at each corner of said upper side of said product stick; and, thereafter rotating a pair of top fold plates each initially recessed into a respective opposite sidewall of said cavity outwardly and down against said wing folds to fold said wing folds and intervening parts of said sheet down against said upper side of said product stick.

2. The method according to claim 1 wherein said product stick is a molded food product.

3. A wrapping device for wrapping a rectangular block-shaped food item in a rectangular sheet of wrapping material, said device including a folding frame having a rectangular through cavity having a pair of spaced apart opposite sides and ends, said cavity configured to slidably receive said food item and wrapping sheet material thereon upon pushing of said food item underlain by said wrapping sheet material into said cavity from an initial position with said food item and wrapping sheet lying over an entry portion of said cavity, and said food item, wrapping sheet, and cavity entry portion centered with respect to each other and having corresponding respective sides parallel to each other;

a pair of rectangular fold forming flat blades fixed to said folding frame at each end of said entry portion of said cavity, each blade having an end and two sides projecting into said cavity from a respective end of said cavity, with a clearance space between said frame cavity sides and said flat blade two sides of a width sufficient to receive a folded section of said wrapping sheet;

said blade projecting ends spaced apart a distance equal to the length of said food item and a thickness of said wrapping sheet;

a first set of two folding fingers fixed to said folding frame at one end of said cavity extending towards each other from opposite sides of said cavity at a position just beyond the end of a respective end of a food item end pushed into said cavity and below one of said flat blades;

a second set of two folding fingers fixed to said folding frame at another end of said cavity extending towards each other from opposite sides of said cavity at a position just beyond a respective end of a food item and below the other of said flat blades;

a pair of pusher shoes movably mounted beyond either end of said cavity, each having a blade portion aligned with a slot in each end of said forming frame extending orthogonally between said sides thereof and entering into said cavity;

actuator means for causing each pusher shoe to be moved so as to cause said blade portion to enter said cavity through said slots; and, a pair of elongated top flap folding plates pivotally extending lengthwise along said cavity but disposed within a respective recess in a cavity side to not normally protrude into said cavity, each of said top flap folding plates pivotally mounted so as to be able to rotate down into said cavity from a retracted position to fold side portions of said wrapping sheet material into said cavity down onto said food item positioned at the bottom of said cavity.

4. The apparatus according to claim 3 wherein each of said two fingers in said first and second sets of folding fingers having an upper surface inclined downwardly from the side of said cavity to which each finger is attached.

5. The apparatus according to claim 4 wherein each of said fingers has a top surface becoming progressively less curved free from said side of said cavity.

6. The apparatus according to claim 5 wherein two fingers in said first set of fingers each terminate before reaching the opposite side of said cavity.

7. The apparatus according to claim 3 wherein said top folding plates in said retracted positions are slightly angled away from said forming frame cavity sides to be completely received in said recesses at a top edge thereof.

8. The apparatus according to claim 3 wherein an edge of each of said two sides and end of each of said flat blades is chamfered to facilitate initiation of said wrapping of said sheet material as said food item is advanced into said cavity.

9. The apparatus according to claim 3 further including molding apparatus for forming said food item, including a mold plate having a plurality of molding cavities arranged into two sets for forming rectangular blocks comprising a plurality of food items, and further including a plurality of wrapping devices including two folding frames each having a set of cavities corresponding to one of said molding cavity sets, and means for mounting said molding plate for shuttling movement below a food product injector so as to alternately bring each cavity set below said food product injector and wherein each of said plurality of folding devices is located beneath a respective set of mold cavities and aligned therewith when said mold cavity set is shuttled away from said food product injector.

10. The apparatus according to claim 3 wherein said cavity is oblong in shape, forming an elongated rectangle.

* * * * *

UNITED STATES PATENT AND TRADEMARK OFFICE

CERTIFICATE OF CORRECTION

PATENT NO. : 5,794,411

DATED : August 18, 1998

INVENTOR(S) : Timothy F. Combs

It is certified that error appears in the above-indentified patent and that said Letters Patent is hereby corrected as shown below:

Column 3, line 40, delete "is a" insert therefor --are--. (Patent Office error).

Column 4, line 33, after "each" insert --other--. (Patent Office error).

Column 6, line 63, after "and" insert --an--. (Patent Office error).

Signed and Sealed this

Ninth Day of February, 1999

*Attest:*

*Acting Commissioner of Patents and Trademarks*

*Attesting Officer*